United States Patent [19]

Sendzimir

[11] Patent Number: 4,768,366

[45] Date of Patent: Sep. 6, 1988

[54] WIDE STRIP MILL USING PRESSURE ELEMENTS

[76] Inventor: Tadeusz Sendzimir, Weekeepeemee Rd., Woodbury, Conn. 06798

[21] Appl. No.: 45,449

[22] Filed: Apr. 30, 1987

[51] Int. Cl.[4] ..... B21B 29/00; B21B 31/20

[52] U.S. Cl. ..... 72/242; 72/237; 72/241; 72/244; 72/245

[58] Field of Search ..... 72/242, 241, 243, 244, 72/245, 237

[56] References Cited

U.S. PATENT DOCUMENTS

| | | | |
|---|---|---|---|
| 2,479,974 | 8/1949 | Sendzimir et al. | 72/242 |
| 3,128,650 | 4/1964 | Leufuen | 72/242 |
| 3,331,231 | 7/1967 | Kaestner | 72/79 |
| 3,363,444 | 1/1968 | Caldeback | 72/245 X |
| 3,533,263 | 10/1970 | Wochnik et al. | 72/242 |
| 3,561,241 | 2/1971 | Blain | 72/242 X |
| 3,572,079 | 3/1971 | Bond | 72/245 |
| 3,762,202 | 10/1973 | Sherwood | 72/245 |
| 4,530,227 | 7/1985 | Schlatter et al. | 72/245 X |
| 4,581,914 | 4/1986 | Masui | 72/242 |
| 4,587,702 | 5/1986 | Kates | 72/238 X |
| 4,653,190 | 3/1987 | Spain, Jr. | 73/526 X |

FOREIGN PATENT DOCUMENTS 1452071 12/1968 Fed. Rep. of Germany ..... 72/242

*Primary Examiner*—Robert L. Spruill
*Assistant Examiner*—Steven B. Katz
*Attorney, Agent, or Firm*—Frost & Jacobs

[57] ABSTRACT

An eight-roll cold strip mill for producing strips of wide width and light gauges, utilizing upper and lower small diameter work rolls, a pair of backing rolls for each work roll, and a driven roll for each work roll contacting the backing rolls thereof. The work rolls, backing rolls and driven rolls are located within a mill housing. The vertical roll separating forces are transmitted to the housing by a plurality of pressure elements operatively connected to the housing and evenly and closely spaced along and contacting the faces of the driven rolls. The horizontal components of the roll separating force are transmitted to the housing by a plurality of pressure elements operatively connected to the housing and evenly and closely spaced along and in contact with the faces of the backing rolls. Each pressure element comprises an arcuate anvil having a concave portion or cavity corresponding to the radius of the respective one of the driven and backing rolls to be supported thereby. The anvil of the pressure element is surrounded by an endless chain of rollers, rotatable thereabout.

17 Claims, 6 Drawing Sheets

WIDE STRIP MILL USING PRESSURE ELEMENTS

TECHNICAL FIELD

The present invention relates to a cold strip mill for producing strip of wide width and light gauge, and more particularly to an eight-roll cold strip mill provided with pressure elements and having better performance characteristics than a conventional 20-roll cold strip mill. The invention also relates to improved pressure elements.

BACKGROUND ART

The wide strip mill of the present invention may be utilized to roll any appropriate strip material. The mill, however, is particularly well adapted for cold-rolling of rapidly work-hardening, tough metal such as stainless steel or silicon steel, and particularly such metal strips of wide width and light gauges. As a result, for purposes of an exemplary showing, the mill will be described in its application to the rolling of wide width, light gauge stainless steel, silicon steel and the like.

Heretofore, for the rolling of wide width, light gauge metallic strip, prior art workers have most often turned to the well-known 20-roll mill of the type taught in U.S. Pat. No. 2,479,974. The 20-roll mill comprises a pair of upper and lower work rolls. Each work roll is provided with a pair of backing rolls, three outer backing rolls (the outermost two of which are usually driven) and four large bearing rolls.

Hundreds of such 20-roll mills are in operation throughout the world and demonstrate excellent performance. These 20-roll mills will accept work rolls which are the smallest for a given width of any mill known. Such 20-roll mills, however, are characterized by certain drawbacks. For example, they are very large, complex in construction, very heavy, expensive to manufacture and its tonage output is limited by the capacity of its eight bearing rolls.

The present invention is based upon the discovery that through the employment of pressure elements, an eight-roll mill can be developed which will greatly out-perform the well known 20-roll mill. The pressure elements can be of the type taught in U.S. Pat. No. 4,603,569 (incorporated herein by reference and described hereinafter). The invention also contemplates new and improved pressure elements to be described hereinafter.

The mill of the present invention utilizes upper and lower work rolls, each provided with backing rolls and only one outer backing roll. The two outer backing rolls of the mill are driven. A total of four outer backing rolls and the eight bearing rolls are eliminated. Each of the backing rolls and the outer backing rolls is provided with a plurality of pressure elements evenly spaced along its face, by which both the vertical and horizontal components of the roll separating force are transmitted to the mill housing. The use of the pressure elements is of extraordinary importance because the pressure elements are capable of withstanding pressures substantially greater than the capacity of the bearing rolls of the 20-roll mill.

The mill of the present invention represents a genuine contribution to the art, as compared to the conventional 20-roll mill, in that it can use optimum diameter work rolls and backing rolls, and requires only two driven rolls. The mill is capable of handling substantially heavier roll pressures, thus reducing the number of passes required and considerably increasing the tonage output for the same size mill. At the same time, the mill of the present invention is far simpler in construction, weighs far less than a conventional 20-roll mill of the same size and can be manufactured at a greatly reduced cost.

With increasing demand for wide width, light gauge, rapidly work-hardening strips such as stainless and silicon steels, the more efficient and less expensive mill of the present invention can result in large savings industry-wide.

The improved pressure elements of the present invention utilize polymer bearing surfaces. They are more wear resistant, do not require lubrication and are less expensive to manufacture. Their use is not limited to the improved mill of the present invention. They can find application wherever rolls require backing or support.

DISCLOSURE OF THE INVENTION

According to the invention there is provided an eight-roll cold strip mill for producing strips of wide width and light gauges. The mill utilizes upper and lower small diameter work rolls, a pair of upper backing rolls for the upper work roll and a pair of lower backing rolls for the lower work roll, and an upper driven roll for the upper work roll and a lower driven roll for the lower work roll.

The work rolls, backing rolls and driven rolls of the mill are located within a mill housing of simplified construction. The vertical components of the roll separating force are transmitted to the housing by a plurality of pressure elements operatively connected to the housing and evenly and closely spaced along and contacting the faces of the upper and lower driven rolls. The horizontal components of the roll separating force are transmitted to the housing by a plurality of pressure elements operatively connected to the housing and evenly and closely spaced along and in contact with the faces of the upper and lower backing rolls. The pressure elements for the two backing rolls of the upper work roll are capable of vertical shifting to accommodate for actuation of the mill screwdown instrumentality.

The pressure elements of the mill of the present invention are essentially identical and can be of the type taught in U.S. Pat. No. 4,603,569. Each pressure element comprises an arcuate body or anvil having a concave portion or cavity corresponding to the radius of the respective one of the driven and backing rolls to be supported by that pressure element. The anvil of the pressure element is surrounded by an endless roller chain which transmits the component of roll separating force to the anvil from its respective backing or driven roll. This component of roll separating force is, in turn, transmitted from the anvil to the housing by a pair of side plates affixed to the anvil and of such size as to space the anvil from the housing by an amount at least sufficient to provide clearance for the return flight of the roller chain about the anvil. The side plates of each pressure element are operatively attached to the adjacent portion of the mill housing.

The present invention further contemplates an improved pressure element which can be used in place of those taught in U.S. Pat. No. 4,603,569. The improved pressure element comprises a plate-supported anvil. The anvil has a depression therein to receive a block of special polymer material to be described hereinafter.

The polymer block has a concave portion corresponding to the radius of the roll to be supported. The concave surface of the block directly contacts a segment of the roll to be supported.

The mill of the present invention may be provided with any appropriate screwdown instrumentality. It may, for example, be provided with a conventional wedge-type screwdown to be described hereinafter.

DETAILED DESCRIPTION OF THE INVENTION

Figure 1:
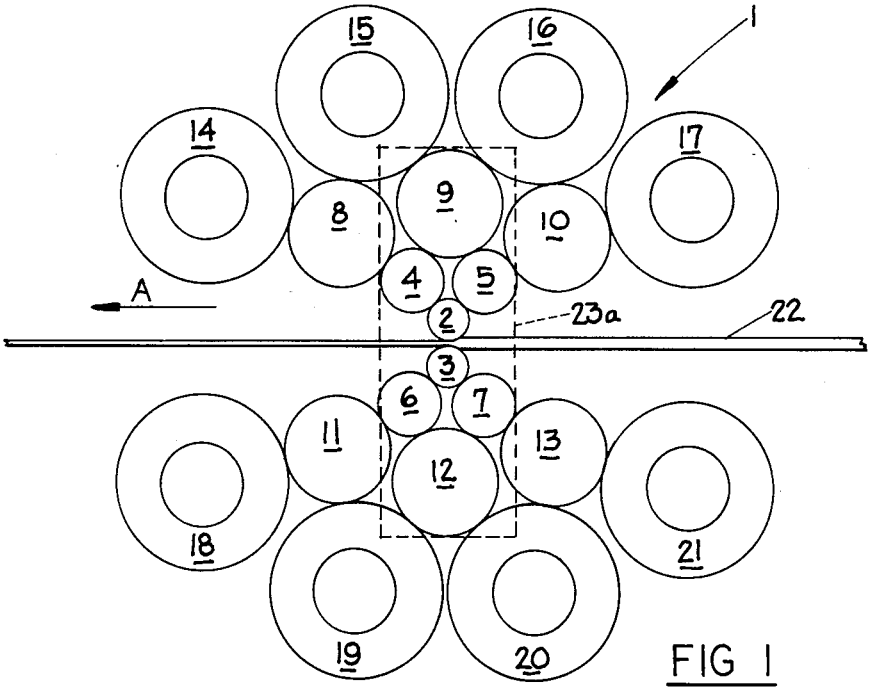
FIG 1 (PRIOR ART)
FIG. 1 is a diagrammatic representation of a conventional prior art 20-roll mill.

As indicated above, the mill of the present invention will be described in its application to the rolling of wide width, light gauge, work-hardening strip such as stainless steel and silicon steel. For a better understanding of the present invention, reference is first made to FIG. 1 which is a diagrammatic representation of the well-known, conventional, 20-roll mill extensively used by prior art workers for this purpose and taught in the above identified U.S. Pat. No. 2,479,974. The mill, generally indicated at 1 comprises an upper work roll 2 and a lower work roll 3. The upper work roll 2 is supported by a pair of backing rolls 4 and 5. Similarly, the lower work roll 3 is supported by a pair of backing rolls 6 and 7. Upper backing rolls 4 and 5 are followed by three outer backing rolls 8, 9 and 10. Lower backing rolls 6 and 7 are similarly supported by outer backing rolls 11, 12 and 13. In the most usual embodiment of such a 20-roll mill, the corner outer backing rolls 8, 10, 11 and 3 are driven. The outer backing rolls 8–10 of upper work roll 2 are backed by bearing rolls 14, 15, 16 and 17. Similarly, the outer backing rolls 11–13 of lower work roll 3 are backed by bearing rolls 18, 19, 20 and 21. The eight bearing rolls 14–21 are mounted on shafts supported by spaced saddles (not shown) installed in troughs (not shown) bored in the mill housing. In FIG. 1, the strip being rolled is indicated at 22 and the rolling direction is indicated by arrow A.

As stated above, hundreds of mills of the type illustrated in FIG. 1 are presently in operation. These 20-roll mills are provided with work rolls 2 and 3 which are the smallest for a given width of any mill in the world.

Figure 2:
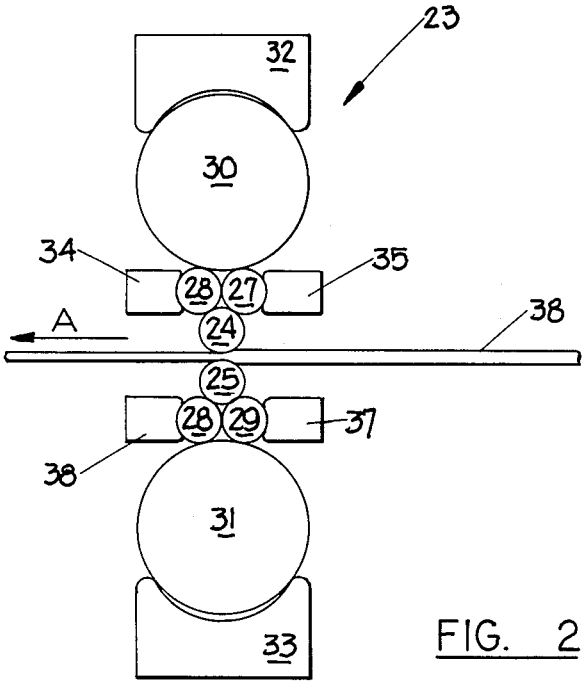
FIG. 2 is a diagrammatic representation, similar to FIG. 1, illustrating the 8-roll mill of the present invention.

Reference is now made to FIG. 2 which is a simplified diagrammatic representation, similar to FIG. 1, of the mill of the present invention.

The mill of the present invention, generally indicated at 23, comprises a pair of upper and lower work rolls 24 and 25. The upper and lower work rolls 24 and 25 may be identical to work rolls 2 and 3 of FIG. 1. The upper work roll 24 is backed by a pair of backing rolls 26 and 27. The lower work roll 25 is similarly backed by a pair of backing rolls 28 and 29. The upper backing rolls 26 and 27 are provided with a single outer backing roll 30. In the same manner, the lower backing rolls 28 and 29 are provided with a single outer backing roll 31. The rolls 30 and 31 are equivalent to rolls 9 and 12, respectively, of FIG. 1, with the exception that rolls 30 and 31 are driven.

It will be apparent that the roll arrangement of the mill 23 of FIG. 2 is similar to that much of the roll arrangement of FIG. 1 enclosed in the broken line rectangle 23*a*.

It will be noted that backing rolls 26, 27, 28 and 29 of FIG. 2 are smaller as compared to work rolls 24 and 25 than backing rolls 4, 5, 6 and 7 of FIG. 1, compared to their respective work rolls 2 and 3. By making backing rolls 26, 27, 28 and 29 smaller, the horizontal force exerted on the pressure elements represented by elements 34, 35, 36 and 37 is greatly diminished. This, in turn, increases the mechanical efficiency of the mill 23 as a whole. Furthermore, the vertical columns of the mill, to be described hereinafter, can be shifted toward the plane of symmetry, thereby making the mill 23 smaller and lighter without impairing its efficiency.

Figure 4:
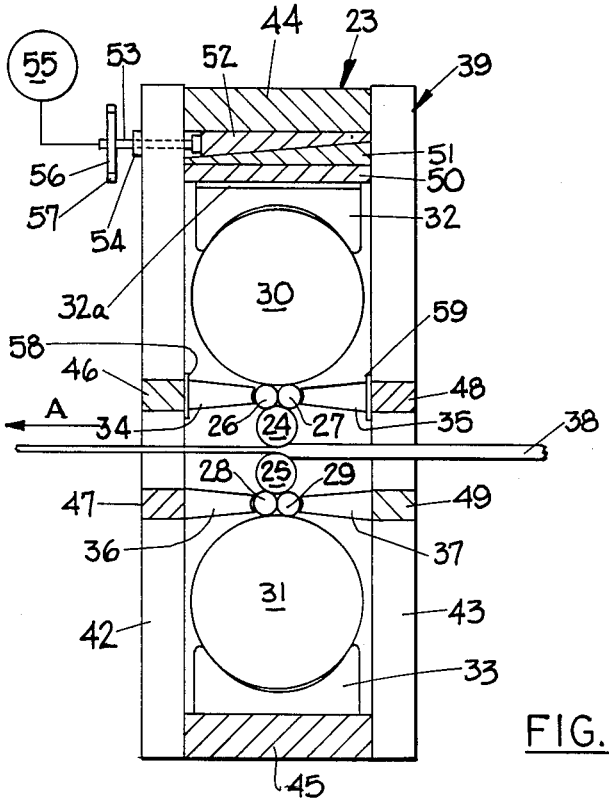
FIG. 4 is a simplified cross-sectional elevational view of the mill of the present invention.

In FIG. 2, backing rolls 26, 27, 28 and 29 are illustrated as being of the same diameter as work rolls 24 and 25. In FIG. 4, a preferred version is shown wherein backing rolls 26, 27, 28 and 29 are of a diameter about half that of working rolls 24 and 25.

A particularly valuable feature of mill 23 of FIG. 2, including a cluster of two backing rolls for each work roll, is that the proportion between the diameter of the work rolls and the backing rolls can be chosen within wide limits, depending upon the rolling program, etc. These limits range from the use of large work rolls and small backing rolls to the use of small work rolls and large backing rolls. Small diameter backing rolls, because of their relative flexibility, permit better control of the distribution of roll pressure across the width of the strip.

Upper and lower outer backing rolls 30 and 31 are each provided with a row of pressure elements closely and evenly spaced along and in contact with the faces of rolls 30 and 31. One pressure element of the row thereof for backing roll 30 is shown at 32. One pressure element of the row thereof for backing roll 31 is shown at 33. Pressure element 32 and the others of its row, and pressure element 33 and the others of its row, are operatively connected to the mill housing (not shown) and transmit the vertical components of the roll separating force thereto. Upper backing rolls 26 and 27 are each provided with a row of pressure elements closely and evenly spaced along their respective roll faces and represented by pressure elements 34 and 35, respectively. Lower backing rolls 28 and 29 are also each provided with row of pressure elements represented by pressure elements 36 and 37, respectively. The rows of pressure elements represented by elements 34–37 are operatively connected to the mill housing and transmit thereto the horizontal components of the roll separating force. It will be immediately apparent from a comparison of FIGS. 1 and 2 that the rows of pressure elements represented by elements 32–37 replace the outer backing rolls 8, 10, 11 and 13, as well as the bearing rolls 14–21 of FIG. 1, rendering the mill 23 of the present invention of simpler and more compact construction than the prior art 20-roll mill 1 of FIG. 1. In FIG. 2, the strip being rolled is diagrammatically illustrated at 38 and the rolling direction is again indicated by arrow A.

The mill of the present invention may be provided with a one-piece mill housing, as is known in the art. Preferably, however, the mill is provided with a fabricated housing. Such a housing is generally indicated at 39 in FIG. 3. The housing comprises four vertical columns 40, 41, 42 and 43, arranged one in each corner. The columns 40–43 are connected at their upper ends by an upper horizontal beam 44 and are connected at their lower ends by a lower horizontal beam 45. Vertical columns 40 and 42 are additionally connected by a pair of horizontal beams 46 and 47. Similarly, vertical columns 41 and 43 are connected by a pair of horizontal beams 48 and 49. The purpose of horizontal beams 46–49 will be apparent hereinafter.

Figure 3:
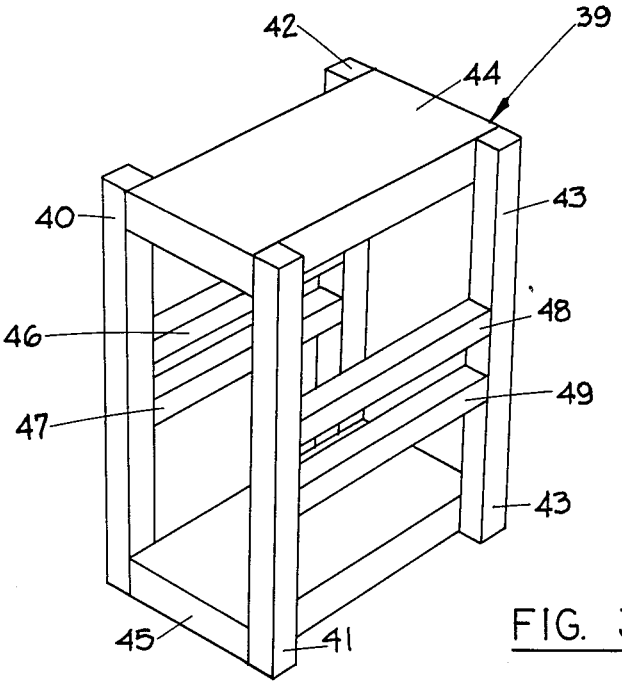
FIG. 3 is a simplified perspective view of an exemplary housing for the mill of the present invention.

FIG. 4 is a simplified cross-sectional elevational view of the housing 39 of FIG. 3 with the various rolls and pressure elements of FIG. 2 mounted therein. To this end, upper and lower work rolls 24 and 25 are shown, as well as upper backing rolls 26 and 27 and lower backing rolls 28 and 29, together with upper outer backing roll 30 and lower outer backing roll 31.

The mill 23 of the present invention may be provided with any appropriate screwdown instrumentality. For purposes of an exemplary showing, it is illustrated as having a wedge-type screwdown assembly. To this end, the screwdown assembly comprises a horizontal plate 50 surmounted by a first wedge member 51. The plate 50 and wedge member 51 are substantially coextensive with the upper housing beam 44. The plate 50 and wedge member 51 are capable of vertical shifting, but means (not shown) are provided to preclude horizontal shifting. A second wedge member 52 is provided located between wedge member 51 and upper housing beam 44. The second wedge member 52 is provided with at least two screws, one of which is shown at 53. The screw 53 is affixed to wedge member 52 and is rotatable with respect thereto. The screw 53 passes through a nut 54 mounted on the mill housing 39. It will be apparent that rotation of screw 53 will result in sideways horizontal displacement of the second wedge member 52. The cooperation of the second wedge member 52 with the first wedge member 51 will result in vertical displacement of wedge member 51 and plate 50, thereby controlling the roll gap. As indicated above, there are at least two screw assemblies of the type just described. The screw assemblies are symmetrically attached to the second wedge member 52, preferably close to its ends. The screw 53 is driven by an appropriate prime mover, diagrammatically indicated at 55.

The screw 53 may be provided with a sprocket 56. The at least one other screw assembly (not shown) may similarly be provided with a sprocket. The sprockets of the screw assemblies are joined together by an endless chain 57. This assures that the displacement of wedge member 52 is strictly parallel, so that the strip 38, being rolled, will be of even thickness. The screw assemblies just described are exemplary only, and other appropriate means may be used to shift wedge member 52. Whatever means are used, it is important that wedge member 52 be shifted equally throughout its length, again to assure a workpiece of even thickness.

The vertical component of roll separating force received by the upper outer backing roll 30 is transmitted to plate 50, wedge members 51 and 52 and upper housing beam 44 through the agency of the row of pressure elements, represented by pressure element 32. These pressure elements, closely and evenly spaced along the face of the upper outer backing roll 30, are affixed to plate 50. The nature of the row of pressure element represented by pressure element 32 is the same as the other pressure elements next to be described, and a full explanation of the pressure elements will be given hereinafter. It is within the scope of the invention to eliminate plate 50 and to affix the row of pressure elements represented by pressure element 32 directly to wedge member 51.

In a similar fashion, the component of vertical roll separating force exerted on the lower outer backing roll 31 is transmitted to the lower housing beam 45 by the row of pressure elements, represented by pressure element 33 in FIG. 4. These pressure elements, closely and evenly spaced along the face of the lower outer backing roll 31, are affixed to the lower housing beam 45. The exemplary screwdown mechanism of FIG. 4 is shown, for purposes of description, as located between the pressure elements represented by pressure element 32 and the top beam 44 of housing 39. It will be understood that the screwdown assembly described could have been mounted near the bottom of mill 23. In such an instance, the plate 50 and wedges 51 and 52 could be located between housing beam 45 and those pressure elements represented by pressure element 33.

The above described rolling mill 23 is capable of producing flat articles of even thickness across their width. In cases, however, where it is desirable to vary the thickness of the workpiece, the present invention is capable of so doing by inserting between each of the above described pressure elements represented at 32 and the beam or plate 50 to which they are affixed, an additional device **32*a* capable of individually controlling the pressure exerted by each pressure element 32 across the width of the face of roll 30**.

For instance, concentrating pressure near the edges of strip 38 and less pressure at its center will produce "crowned" strip, slightly thicker in the center than at the edges. These supplementary devices **32*a* each are like an envelope of springy steel sheets, individually connected to a controlled source of fluid pressure (not shown). The supplementary devices 32*a* could be associated with the pressure elements represented at 33, rather than in association with pressure elements represented at 32**, and the same results could be achieved thereby.

Beside the vertical components of the roll separating force, the backing rolls 26–29 are also subject to lateral components of the roll separating force. To transmit the horizontal component of roll separating force to which upper backing roll 26 is subjected, from upper backing roll 26 to the housing 39, the upper backing roll 26 is provided with the row of pressure elements represented by pressure element 34. These pressure elements, closely and evenly spaced along the face of roll 26, are operatively attached to housing beam 46. Similarly, the row of pressure elements of upper backing roll 27, one of which is shown at 35, are all operatively attached to housing beam 48. In the same manner, the row of pressure elements for lower backing roll 28, one of which is shown at 36, are attached to housing beam 47. Finally, the row of pressure elements for lower backing roll 29, one of which is shown at 37, are affixed to housing beam 49.

It will be appreciated that the pressure elements for upper backing rolls 26 and 27, represented by pressure elements 34 and 35, respectively; are mounted in ways, two of which are shown at 58 and 59. This enables the pressure elements represented by pressure elements 34 and 35 to shift vertically when the screwdown instrumentality is actuated.

The pressure elements represented by pressure elements 34–37 are identical. The pressure elements 32 and 33, cooperating with the outer backing rolls 30 and 31, respectively, can also be identical, differing only from the pressure elements 34–37 in size. As indicated above, the pressure elements employed in the mill 23 of the present invention can be of the type taught in previously mentioned U.S. Pat. No. 4,603,569, in the name of the same inventor. Since all of the pressure elements are the same, some differing only in size, a description of pressure element 34 as shown in FIG. 2, cooperating with backing roll 26, can be considered a description of all of the pressure elements of the mill 23 of FIGS. 2 and 4.

Figure 5:
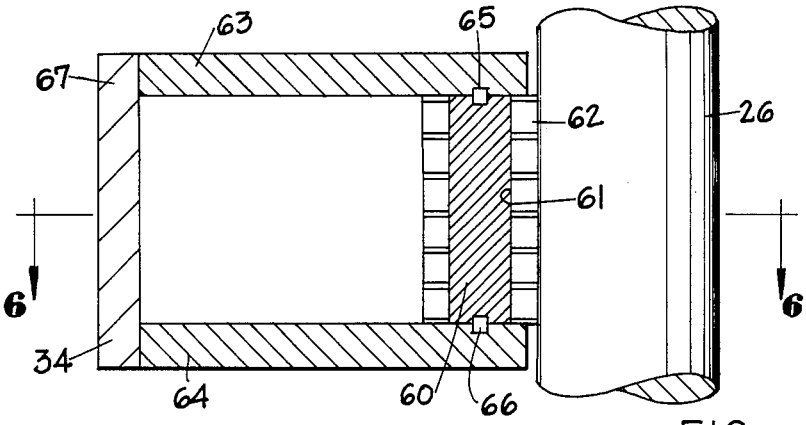
FIG. 5 (PRIOR ART)
FIG. 5 is a simplified, fragmentary, cross-sectional plan view of a prior art pressure element and the roll with which it cooperates.
Figure 6:
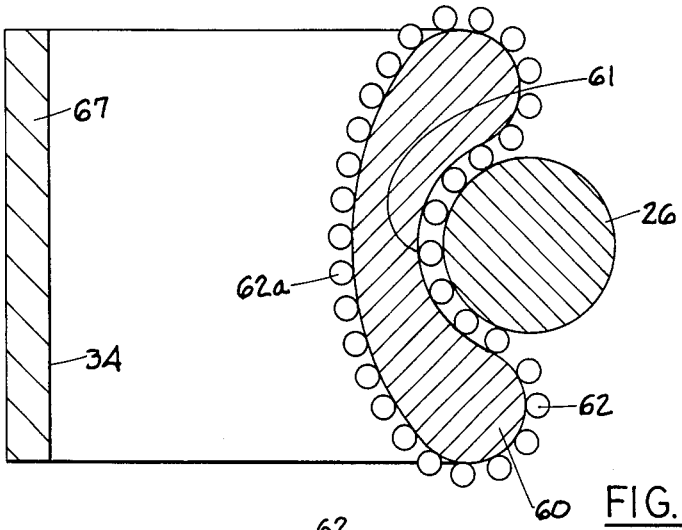
FIG. 6 (PRIOR ART)
FIG. 6 is a cross-sectional view taken along section line 6—6 of FIG. 5.

Reference is made to FIGS. 5 and 6, wherein pressure element 34 and roll 26 are shown. The pressure transmitting element 34 comprises an arcuate anvil or body portion 60. The arcuate configuration of anvil 60 forms a cavity or depression 61 to receive the load (i.e., its respective component of the roll separating force). The depression 61 surrounds a part of the periphery of a sector of roll 26. The same would be true of the depressions of all of the pressure elements evenly and closely spaced in a row along the face of roll 26. The anvil 60 is surrounded by an endless chain of rollers 62 which is rotatable thereabout and which transmits the pressure exerted by backing roll 26 to the anvil 60. The return flight of the chain of rollers 62 is shown at 62*a*.

A pair of side plates 63 and 64 are keyed as at 65 and 66 (or otherwise appropriately affixed) to the anvil 60. Side plates 63 and 64 are welded or otherwise appropriately affixed to a base plate 67. The base plate 67, in turn, is mounted in the ways 58 (see FIG. 4). In the instance of pressure elements 28–31, the base plate may be bolted or otherwise affixed directly to its respective part of the mill housing 39. It would be within the scope of the invention, with respect to those pressure elements bolted or otherwise affixed directly to the housing 39, to eliminate base plate 67 and simply weld or otherwise appropriately affix the side plates 63 and 64 to the adjacent housing portion.

Figure 7:
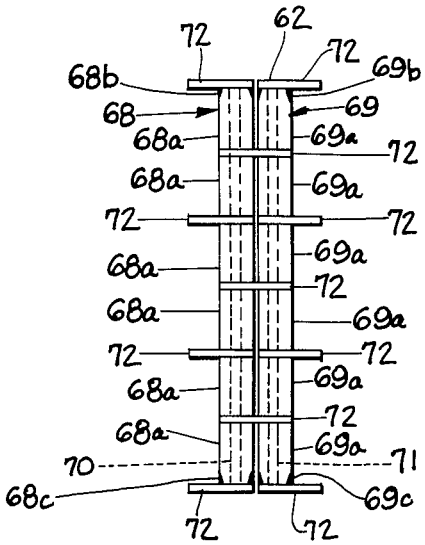
FIG. 7 (PRIOR ART)
FIG. 7 is a fragmentary plan view of the roller chain of FIGS. 5 and 6.

FIG. 7 shows a preferred embodiment of chain of rollers 62, as is taught in the above identified U.S. Pat. No. 4,603,569. FIG. 7 illustrates a short length of two neighboring rollers, generally indicated at 68 and 69. Each of the rollers 68 and 69 comprises a number of short roller segments 68*a* and 69*a*. While the number of roller segments is not limiting, for purposes of an exemplary showing, the rollers 68 and 69 are illustrated as being made up of six such segments. The segments of each roller 68 and 69 are mounted on a single pin or shaft 70 and 71, respectively. Hardened and ground steel rollers, whether they are for roller bearings, roller chains or frictionless glideways, usually having a diameter to length ratio of 1/1 to 1/2. This is dictated by manufacturing considerations such as warpage, heat treating and centerless grinding. The rollers should have a diameter such that they will extend beyond the profile of the links 72 connecting shafts 70 and 71.

Since the chain of rollers 62 transmits no tension, the links 72 therebetween can be very thin (0.020 inch spring steel links for ½ inch diameter rollers). The thinness of the links 72 gives a two-fold advantage. First of all, very little axial space is lost. Secondly, elastic depression caused in the roll 26 by the rollers 68 and 69 is practically constant over the faces of the entire rollers, so that only the outermost ends of the endmost segments 68*a* and 69*a* need be slightly tapered to prevent stress concentration, as shown at 68*b*, 68*c*, 69*b* and 69*c*.

Figure 9:
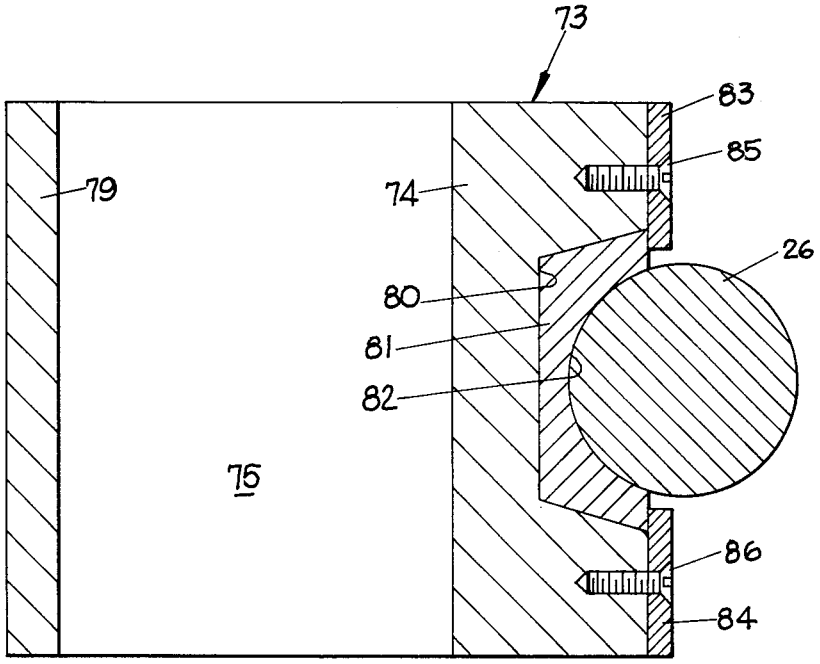
FIG. 9 is a cross-sectional view taken along section line 9—9 of FIG. 8.
Figure 8:
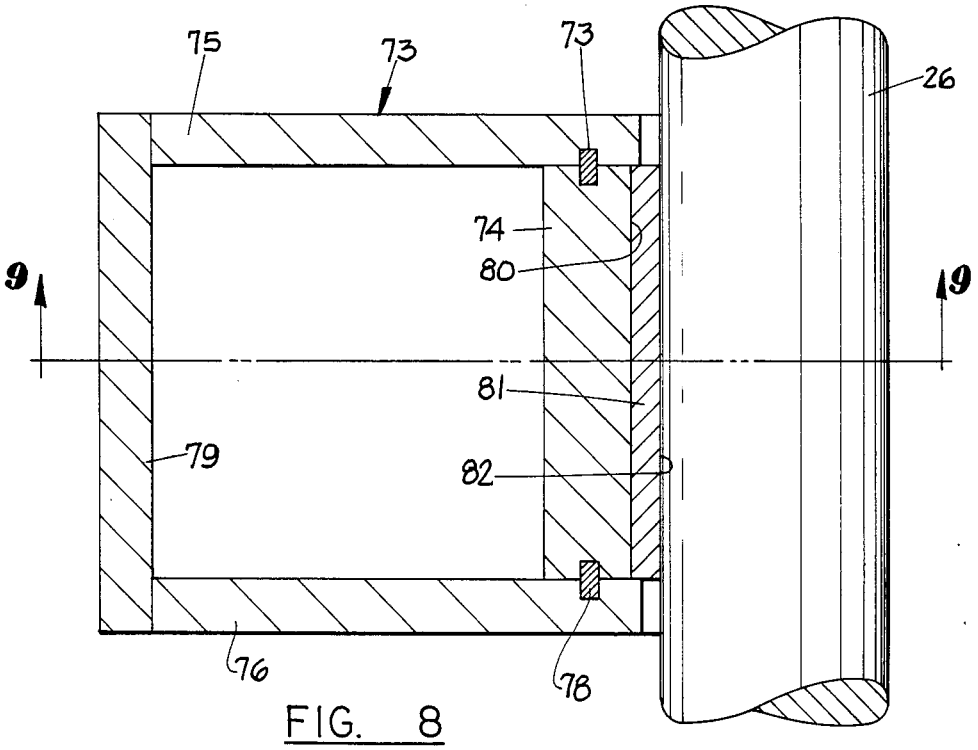
FIG. 8 is a simplified, fragmentary, cross-sectional view of the improved pressure element of the present invention.

FIGS. 8 and 9 illustrate a new and preferred form of pressure element which can be used as the pressure elements of mill 23 of FIG. 4, represented in that figure by pressure elements 32 through 37. It will be noted that FIGS. 8 and 9 are similar to FIGS. 5 and 6. The pressure element of FIGS. 8 and 9 is generally indicated at 73. The pressure element 73 comprises an anvil 74 to which a pair of side plates 75 and 76 are keyed as at 77 and 78 (or otherwise appropriately affixed). The side plates 75 and 76 may be appropriately affixed to a base plate 79. The base plate 79, in turn, is adapted to be mounted on its appropriate portion of mill housing 39. Where intended to be affixed directly to a housing element such as the beam 45, the beams 47 and 49 or the plate 50, the base plate 79 could be eliminated and the side plates 75 and 76 welded directly to such housing elements.

The anvil 74 comprises a rectangular metallic block having a depression 80 formed therein. The depression 80 is adapted to receive a polymer insert 81.

For purposes this explanation, it will be assumed that the pressure element 73 is to be substituted for each of the pressure elements represented at 34 of FIG. 4 and contacting roll 26. The polymer insert 81 has an arcuate, concave bearing surface 82 sized to serve as a bearing surface for roll 26. Insert 81 is maintained within depression 80 by a pair of clamping plates 83 and 84 affixed to anvil 74 by a series of screws represented by screws 85 and 86. Axial or endwise movement of insert 81 is precluded by side plates 75 and 76.

There has recently been developed polymer material capable of serving as bearing surfaces and outwearing bronze 4:1. An example of such material is sold under the registered trademark NYLATRON, and the designation GSM Nylon, by Polypenco of Reading, Pennsylvania. This material is characterized by the following bearing properties:

| Coefficient of Friction | |
|---|---|
| Static | .18–.30 |
| Dynamic | .25–.28 |
| Wear Factor "K" $\times 10^{-10}$ | 110 |

Phrases such as "polymer insert" and "polymer material" as used herein and in the claims, refers to this material or its equivalent.

A pressure element or supporting device of the type just described with respect to FIGS. 8 and 9 represents a major improvement over pressure elements described with respect to FIGS. 5–7. The pressure element of the general type described with respect to FIGS. 8 and 9 is characterized by remarkable wear resistance. In addition, no lubricant is required and the pressre element is less expensive to manufacture than that illustrated in FIGS. 5–7. Again, all of the pressure elements represented by pressure elements 32 through 37 of FIG. 4 can be of the type described with respect to FIGS. 8 and 9. Such a mill would be practically maintenance-free for a year of day and night operation.

The conventional 20-roll mill of FIG. 1 can only withstand a roll separating force within the capacity of the bearing rolls 14–21. It has been determined, on the other hand, that the pressure elements just described with respect to FIGS. 5–7 and FIGS. 8 and 9 are capable of withstanding roll separating forces much greater than the capacity of the 20-roll mill.

From the above description of the mill of the present invention, it will be apparent that the present aill represents a great improvement over the 20-roll mill of the prior art. The mill of the present invention can utilize optimum diameter work and backing rolls, but requires only two driven rolls. The mill of the present invention permits far greater roll pressures, thus reducing the number of passes required and obtaining greater tonage than from the same size 20-roll mill. The weight of the mill of the present invention is only about half that of the conventional 20-roll mill. Its corstruction is simpler than that of the conventional 20-roll mill, and it is therefore less costly to manufacture.

Figure 10:
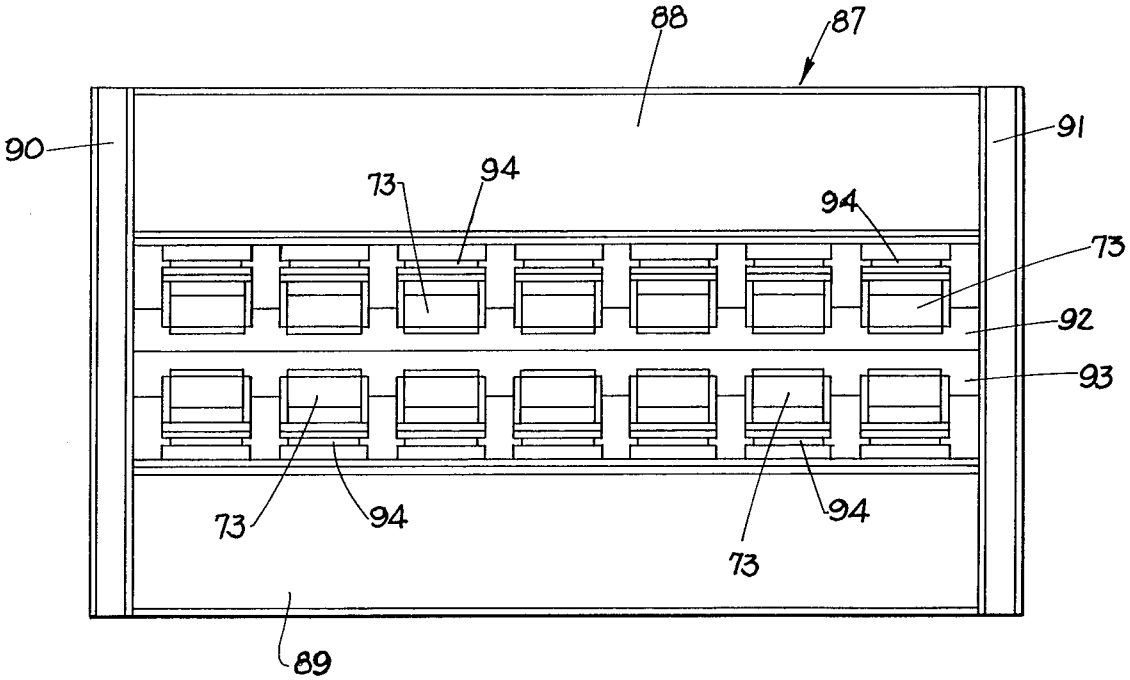
FIG. 10 is a simplified elevational view of the mill of U.S. Pat. No. 4,603,569 provided with pressure elements of the type shown in FIGS. 8 and 9.

It will be understood by one skilled in the art that pressure elements or support elements of the type described with respect to FIGS. 8 and 9 are not limited in their application to the mill of FIG. 4. The pressure element of FIGS. 8 and 9 can be used in substantially any application where rolls require support. This is true of paper mills, rubber mills, mills for rolling certain types of plastics, as well as metallic plate and strip mills. As an example, FIG. 10 is a simplified side elevational view of the mill of U.S. Pat. No. 4,603,569 for rolling a workpiece, and particularly a workpiece of great width. Briefly, the mill housing generally indicated at 87 comprises two backing beams 88 and 89 joined together at their ends by pairs of mill columns, two of which are shown at 90 and 91. The mill houses a pair of chock-mounted, small diameter work rolls 92 and 93. Pressure transmitting elements are evenly spaced across the face of each work roll 92 and 93, the pressure transmitting elements for the upper work roll 92 being operatively affixed to the upper backing beam 88 and the pressure transmitting elements for the lower work roll 93 being operatively connected to lower backing beam 89. In FIG. 10, the pressure elements for the upper and lower work rolls 92 and 93 are illustrated as being of the type illustrated at 73 in FIGS. 8 and 9 of the present application.

In accordance with the teachings of U.S. Pat. No. 4,603,569, the pressure elements for at least one of the upper and lower work rolls 92 and 93 are provided with fluid pressure means, by which the pressure exerted by each pressure element can be instantly controlled (i.e., increased or decreased). The pressure elements of the other one of the upper and lower work rolls 92 and 93 may each be similarly provided with fluid pressure means. Such fluid pressure means are indicated for the pressure elements of both work rolls at 94. It has been found, however, that it suffices to control the pressure of only one of the two work rolls 92 and 93. Therefore, the pressure elements of the other work roll may, if desired, be rigidly attached to its respective beam.

Figure 11:
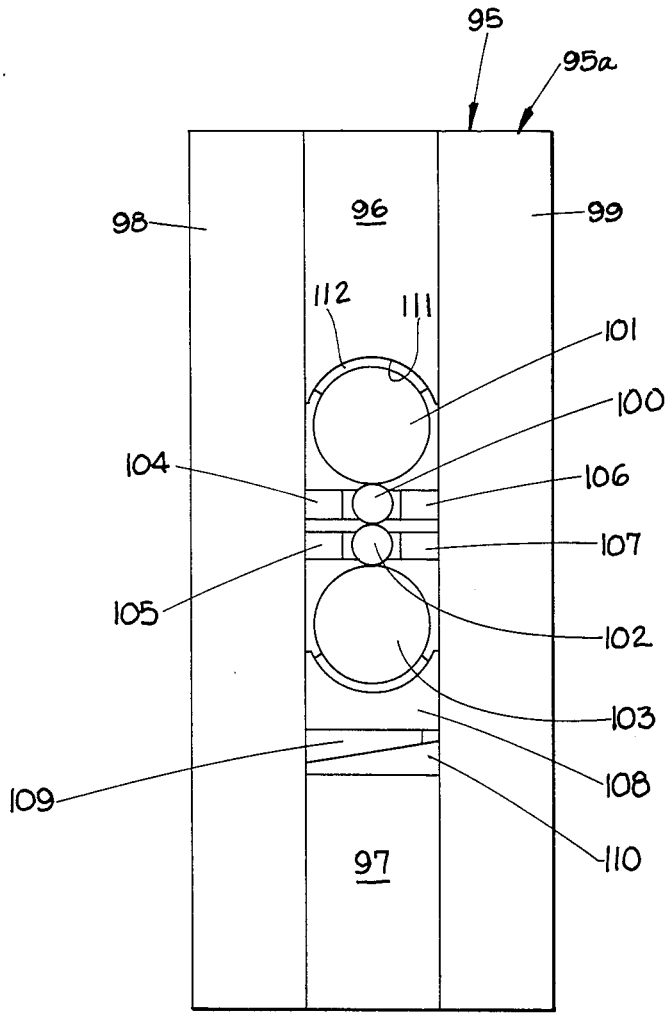
FIG. 11 is a simplified end elevational view of a 4-high mill provided with the pressure elements of FIGS. 8 and 9.

As a further example of the versatility of the pressure element of FIGS. 8 and 9, reference is now made to FIG. 11. A simplified embodiment of a four-high mill is shown in FIG. 11 at 95. The mill housing, generally indicated at **95*a*, comprises upper and lower beams 96 and 97, joined together at their ends by vertical columns, two of which are shown at 98 and 99**.

The mill 95 is provided with an upper work roll 100 and an upper backing roll 101 together with a lower work roll 102 and a lower backing roll 103.

The horizontal components of the rolls separating forces are transmitted to housing **95*a* by a series of pressure elements on either side of work rolls 100 and 102 mounted on horizontal beams (not shown) constituting part of mill housing 95*a*. These pressure elements are represented by pressure elements 104 through 107. These pressure elements are of the type illustrated in FIGS. 8 and 9 of the present application. The vertical roll separating force acting upon backing roll 103 is transmitted to housing 95*a* by a plurality of pressure elements extending along the face of backing roll 103 and represented by pressure element 108. The pressure elements represented at 108 can be identical to the pressure element of FIGS. 8 and 9. The pressure elements represented by element 108 are, for purposes of an exemplary showing, illustrated as being mounted on wedge element 109 of wedge-type screwdown assembly 109–110. The screwdown assembly 109–110 may be identical to wedge-type screwdown assembly 51–52, described with respect to FIG. 4**.

The upper backing roll 101 may be provided with a plurality of pressure elements identical to the pressure elements of lower backing roll 103, represented by pressure element 108. Alternatively, the upper beam 96 may, itself, serve as a pressure element. To this end, beam 96 in FIG. 11 is shown as having a concave bottom surface 111 provided with a liner 112 of the same polymer material of which the insert 81 of FIGS. 8 and 9 is made. The surface 111 and liner 112 are configured to engage and serve as a pressure element for the face of backing roll 101. It will be appreciated by one skilled in the that the same sort of structure could be employed with respect to the outer backing roll 31 of the mill 23 of FIG. 4. In other words, the beam 45 could be configured similarly to the beam 96 of FIG. 11 and provided with a liner equivalent to liner 112 for engagement of the face of outer backing roll 31.

Modifications may be made in the invention without departing from the spirit of it.

What is claimed is:

1. An eight-roll mill for cold rolling wide width light gauge strip material, said mill comprising upper and lower small diameter work rolls, upper and lower pairs of backing rolls contacting and backing each of said upper and lower work rolls respectively, an upper driven roll contacting and backing said upper pair of backing rolls and a similar lower driven roll contacting and backing said lower pair of backing rolls, a mill housing containing said rolls, a row of pressure elements for each of said four backing rolls and said two driven rolls, said pressure elements of each row being closely and evenly spaced along and in contact with the face of its respective roll, each of said rows of pressure elements being operatively attached to an adjacent part of said mill housing, said rows of pressure elements of said driven rolls transmitting the vertical components of the roll separating force to said housing and said rows of pressure elements of said four backing rolls transmitting the horizontal components of the roll separating force to said housing.

2. The mill claimed in claim 1 wherein each of said pressure elements of said rows thereof comprise an anvil having a concave surface surrounding a part of the periphery of a sector of its respective roll, an endless roller chain surrounding said anvil and being rotatable thereabout, said anvil and its surrounding roller chain being operatively attached to an adjacent part of said housing by a pair of parallel side plates affixed to the ends of said anvil.

3. The mill claimed in claim 1 wherein each of said pressure elements of said rows thereof comprises an anvil, a block of nylon polymer bearing material, said nylon polymer bearing material having a static coefficient of friction of about 0.18 to about 0.30, a dynamic coefficient of friction of about 0.25 to about 0.28, and a wear factor $K \times 10^{-10}$ of about 110, said nylon polymer block being mounted on said anvil, said nylon polymer block having a concave surface contacting and surrounding a part of the periphery of a sector of its respective roll and means operatively attaching said anvil to an adjacent part of said housing.

4. The mill claimed in claim 1 wherein said mill housing comprises four vertical columns constituting the housing corners, said columns being connected at their upper ends by an upper horizontal beam and at their lower ends by a lower horizontal beam, a first pair of side beams extending horizontally and in parallel spaced relationship along one side of said housing and being connected to the adjacent pair of said columns, a second pair of side beams extending horizontally and in parallel spaced relationship along the other side of said housing and being connected to the remaining pair of said columns, screwdown means being provided for said mill housing, said row of pressure elements for said upper driven roll being operatively affixed to said upper horizontal beam by means of said screwdown means, the row of pressure elements for said lower driven roll being affixed to said lower horizontal beam, said rows of pressure elements for said lower pair of backup rolls being mounted on adjacent ones of said side beams, and said rows of pressure elements for said upper pair of backup rolls being operatively attached to the adjancent ones of said side beams by means permitting vertical shifting of said last mentioned rows of pressure elements when said screwdown means is actuated.

5. The mill claimed in claim 1 wherein said upper and lower work rolls are of the same diameter, said upper and lower backing rolls are each of a diameter equal to the diameter of said work rolls.

6. The mill claimed in claim 1 wherein said upper and lower work rolls are of the same diameter, said upper and lower backing rolls being of a diameter less than the diameter of said work rolls.

7. The mill claimed in claim 1, including means in association with each of said pressure elements of said row for said upper driven roll to individually control the pressure exerted by each of said last mentioned pressure elements.

8. The mill claimed in claim 2 wherein each roller of said chain of rollers comprises a plurality of roller segments mounted on a shaft, the shafts of adjacent rollers being joined together by thin spring steel links, the outermost ends of the outermost roller segments being slightly tapered.

9. The mill claimed in claim 4 wherein said screwdown means comprises upper and lower coextensive wedge elements located beneath said upper horizontal housing beam, said upper wedge element being in contact with said upper horizontal housing beam and said lower wedge element, means mounting said upper wedge element in said housing for horizontal movement perpendicular to its long axis, a plate mounted beneath and in contact with said lower wedge element, means mounting said lower wedge element and said plate within said housing for vertical movement, said row of pressure elements for said upper driven roll being attached to said plate, and means to shift said upper wedge element horizontally to shift said lower wedge element and said plate vertically to control the gap between said upper and lower work rolls.

10. The mill claimed in claim 4 wherein said upper and lower work rolls are of the same diameter, said upper and lower backing rolls are each of a diameter equal to the diameter of said work rolls.

11. The mill claimed in claim 4 wherein said upper and lower work rolls are of the same diameter, said upper and lower backing rolls being of a diameter less than the diameter of said work rolls.

12. The mill claimed in claim 4 including means in association with each of said pressure elements of said row for said upper driven roll to individually control the pressure exerted by each of said last mentioned pressure elements.

13. The mill claimed in claim 4 wherein each of said pressure elements of said rows thereof comprise an anvil having a concave surface surrounding a part of the periphery of a sector of its respective roll, an endless roller chain surrounding said anvil and being rotatable thereabout, said anvil and its surrounding roller chain being operatively attached to its respective part of said mill by a pair of parallel side plates affixed to the ends of said anvil.

14. The mill claimed in claim 4 wherein each of said pressure elements of said rows thereof comprises an anvil, a block of nylon polymer bearing material, said nylon polymer bearing material having a static coefficient of friction of about 0.18 to about 0.30, a dynamic coefficient of friction of about 0.25 to about 0.28, and a wear factor $K \times 10^{-10}$ of about 110, said nylon polymer block being mounted on said anvil, said nylon polymer block having a concave surface contacting and surrounding a part of the periphery of a sector of its respective roll and means operatively attaching said anvil to adjacent part of said housing.

15. The mill claimed in claim 13 wherein each roller of said chain of rollers comprises a plurality of roller segments mounted on a shaft, the shafts of adjacent rollers being joined together by thin spring steel links, the outermost ends of the outermost roller segments being slightly tapered.

16. An eight-roll mill for cold rolling wide width light gauge strip material, said mill comprising upper and lower small diameter work rolls, upper and lower pairs of backing rolls contacting and backing each of said upper and lower work rolls respectively, an upper driven roll contacting and backing said upper pair of backing rolls and a similar lower driven roll contacting and backing said lower pair of backing rolls, a mill housing containing said rolls, said mill housing comprising four vertical columns constituting the housing corners, said columns being connected at their upper ends by an upper horizontal beam and at their lower ends by a lower horizontal beam, a first pair of side beams extending horizontally and in parallel spaced relationship along one side of said housing and being connected to the adjacent pair of said columns, a second pair of said beams extending horizontally and in parallel spaced relationship along the other side of said housing and being connected to the remaining pair of said columns, screwdown means being provided for said mill housing, a row of pressure elements for each of said four backing rolls and one of said upper and lower driven rolls, said pressure elements of each row being closely and evenly spaced along and in contact with the face of its respective roll, each of said rows of pressure elements for said backing rolls being operatively attached to the adjacent one of said side beams, said row of pressure elements for said one of said upper and lower driven rolls being operatively attached to the adjacent one of said upper and lower horizontal beams, the other of said upper and lower horizontal beams comprising a pressure element for the other of said upper and lower driven rolls, said last mentioned horizontal beam having a concave surface surrounding a part of the periphery of the adjacent one of said upper and lower driven rolls, a layer of nylon polymer bearing material mounted on said concave surface and in contact with said adjacent one of said upper and lower driven rolls, said nylon polymer bearing material having a static coefficient of friction of about 0.18 to about 0.30, a dynamic coefficient of friction of about 0.25 to about 0.28, and a wear factor $K \times 10^{-10}$ of about 110.

17. The mill claimed in claim 16 wherein each of said pressure elements of said rows thereof comprisies an anvil, a block of said nylon polymer beaaring material mounted on said anvil, said nylon polymer block having a concave surface contacting and surrounding a part of the periphery of a sector of its respective roll and means operatively attaching said anvil to its respective part of said housing.

* * * * *